United States Patent [19]

Russell

[11] 4,244,128

[45] Jan. 13, 1981

[54] PAPERBOARD PICTURE DISPLAY

[75] Inventor: Dennis E. Russell, Craighead City, Ark.

[73] Assignee: Alton Box Board Company, Alton, Ill.

[21] Appl. No.: 11,131

[22] Filed: Feb. 12, 1979

[51] Int. Cl.[3] ..... G09F 1/12

[52] U.S. Cl. ..... 40/154; 40/155; 40/158 A

[58] Field of Search ..... 40/154, 155, 156, 152, 40/152.1, 158 A, 158 R, 124.1, 539

[56] References Cited

U.S. PATENT DOCUMENTS

| | | | |
|---|---|---|---|
| 796,310 | 8/1905 | Fisher | 40/154 |
| 1,140,904 | 5/1915 | Kiernan | 40/158 A |
| 2,021,018 | 11/1935 | Paige | 40/154 X |
| 2,772,499 | 12/1956 | Ferrucci | 40/154 |
| 2,814,896 | 12/1957 | Fujikawa | 40/155 |

FOREIGN PATENT DOCUMENTS

| | | | |
|---|---|---|---|
| 1534932 | 6/1968 | France | 40/154 |

*Primary Examiner*—John F. Pitrelli
*Attorney, Agent, or Firm*—Paul M. Denk

[57] ABSTRACT

In a picture display formed of paperboard, a front perimeter frame includes an opening to accommodate a framed picture for viewing, the frame incorporates an integral strap across each of the opening corners, side and end walls foldably connect with the outer perimeter of the front frame, and flanges connecting with the walls fold around the back side of the frame to form a back perimeter frame thereof, and secure the displayed picture in place. Spacer elements foldably connecting with the inner edges of the front perimeter frame opening fold interiorly of the display for centrally positioning the held picture for convenient viewing.

5 Claims, 5 Drawing Figures

PAPERBOARD PICTURE DISPLAY

BACKGROUND OF THE INVENTION

This invention relates generally to folding cartons, more specifically is concerned with the fabrication from an individual blank of paperboard a carton like means useful for conveniently displaying a framed picture or the like.

Numerous cartons are available in the prior art for use in displaying merchandise and other wares for sale. But, the formation of a combination display and protective carton peripheral frame of paperboard and for use specifically for encompassing a framed picture, or related type item, does not appear to have been given consideration in such prior art. Generally, what form of protection has been available for framed pictures includes the formation only of rather triangularly shaped paperboard segments that are adaptable for insertion only upon the corners of the picture, or the frame embodied on the latter, and in this manner, prevents damage to only these corner peripheral edges of such items, but generally only during usage.

The current invention is principally concerned with achieving the objective of furnishing not only complete protection to the entire perimeter of the framed picture, but in addition, furnishes near complete viewing of the entire enclosed picture and its frame so that the purchaser can readily observe the picture or painting and its frame, he is considering purchasing, and at the same time, be assured that the utmost care has been taken to preserve it from damage due to the presence of the peripheral encompassing paperboard display.

Another object of this invention is to provide a design for forming a picture frame from a unitary blank from paperboard materials.

Another object of this invention is to provide a picture display incorporating various integral structure that conveniently positions the framed picture centrally for near full viewing.

Another object of this invention is the provision of strap means in a picture display for use for embracing and holding the framed picture within the confines of the protection furnished by its surrounding display structure.

Yet another object of this invention is to provide a picture display that conveniently protects the entire periphery of the framed picture, but yet allows convenient visual access to the picture along its frontal and back portions.

Yet another object of this invention is the provision of a display that may be conveniently folded either manually by a single individual, or by machine, in a problem free manner.

These and other objects will become more apparent to those skilled in the art upon reviewing the summary of this invention, and upon undertaking a study of the description of its preferred embodiment, in view of the drawing.

SUMMARY OF THE INVENTION

This invention contemplates the formation of a picture display from an individual sheet of paperboard material, formed initially as a blank, and which then may be conveniently folded into a picture surrounding configuration so as to insure the combination of both protectiveness for the enclosed picture, and furnish almost full viewing of its aesthetic characteristics. This display essentially incorporates a front and a back perimeter frame that is foldably connected together through the agency of interviening side and end walls, each of these frames having substantial openings at their central portions so as to furnish unencumbered viewing of the merchandise packaged therein. The front perimeter frame essentially incorporates a substantial opening therethrough, and of dimensions that are slightly greater than the overall dimensions of the framed picture to be packaged therein. A series of integral straps span between adjacent corner segments of the front perimeter frame, and in this manner embrace the corners of the framed picture therein, securing it firmly in place interiorly of the folded display. A series of spacer means are also foldably connected along the inner edges of the front perimeter frame opening, are folded initially inwardly towards the back frame, and include another flange that folds in a direction towards the said proximate wall for acting as positioners that stabilize the spacers firmly in place, and to thereat function as the means for conveniently positioning any framed picture centrally within the enclosing display. To further aid in the proper positioning of the picture within the display, additional flanges are foldably provided at each corner of the front perimeter frame opening, and within the confines of the spanning corner straps, as previously explained, and which flanges may be bent downwardly for also biasing against the immediate corners of the framed picture for enhancing its proper position, and to allow a clear view of the picture's corners.

Thus, in view of the foregoing, the picture display incorporates integral structure from a single blank of paperboard material that functions to firmly secure the displayed picture with this display, while at the same time, furnishing substantially complete protection around the frame or picture perimeter insuring against any impacting damage thereto, and while generally providing almost full viewing of the aesthetical aspects of the framed picture as held.

DESCRIPTION OF THE PREFERRED EMBODIMENT

Figure 1:
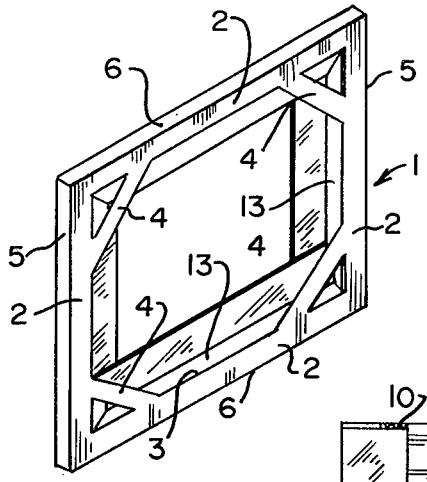
FIG. 1 provides an isometric view of the picture display of this invention.
Figure 2:
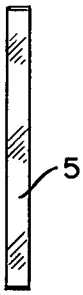
FIG. 2 provides a side view of the display of FIG. 1.
Figure 3:
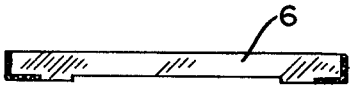
FIG. 3 furnishes an end view of the picture display of FIG. 1.

In referring to the drawings, in the particular FIGS. 1 through 4, there is disclosed the paperboard picture display 1 of this invention, being generally rectangular in configuration, and of the size to accommodate a framed picture of selected dimensions. The display 1 includes a front perimeter frame 2 around its periphery, with the said frame having an opening, as at 3, therethrough and of a size slightly greater than the dimensions of the framed picture being displayed therein. Integrally connecting with joined segments of the front perimeter frame 2, at each corner thereof, is a strap 4 with one of said straps being located at each corner of said frame, but it is likely that the display could be fabricated utilizing only two such straps, at opposing corners of the opening 3, and yet be able to maintain the security of the embraced picture displayed therein.

Figure 4:
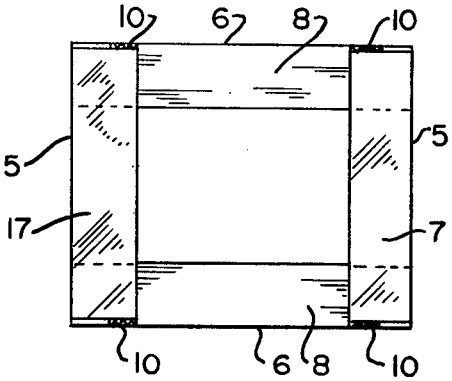
FIG. 4 shows a back view of the picture display of FIG. 1.

Foldably connecting with each side edge of the perimeter frame 2 are the side walls 5 in the display, and in addition, foldably connecting with the upper and lower edges of the same display are the end walls 6. The side and end walls have a width dimension approximating the thickness of the framed picture to be held therein, so that the picture may be conveniently fitted within the interior of the display after it has been folded around the same so as to provide for its securement during both a period of display and shipment. Foldably connecting with the outside edges of the walls 5 and 6 are the side and end flanges 7 and 8, respectively, and which when folded over into a relationship as shown in FIG. 4, forms a back perimeter frame for the held picture. A tab 9 is formed at opposite edges of the side flanges 7, and these tabs are disposed for inserting into the slots 10 formed along the margin of the fold line 11 arranged between the end walls 6 and the end flanges 8 as shown. See the blank of FIG. 5.

Figure 5:
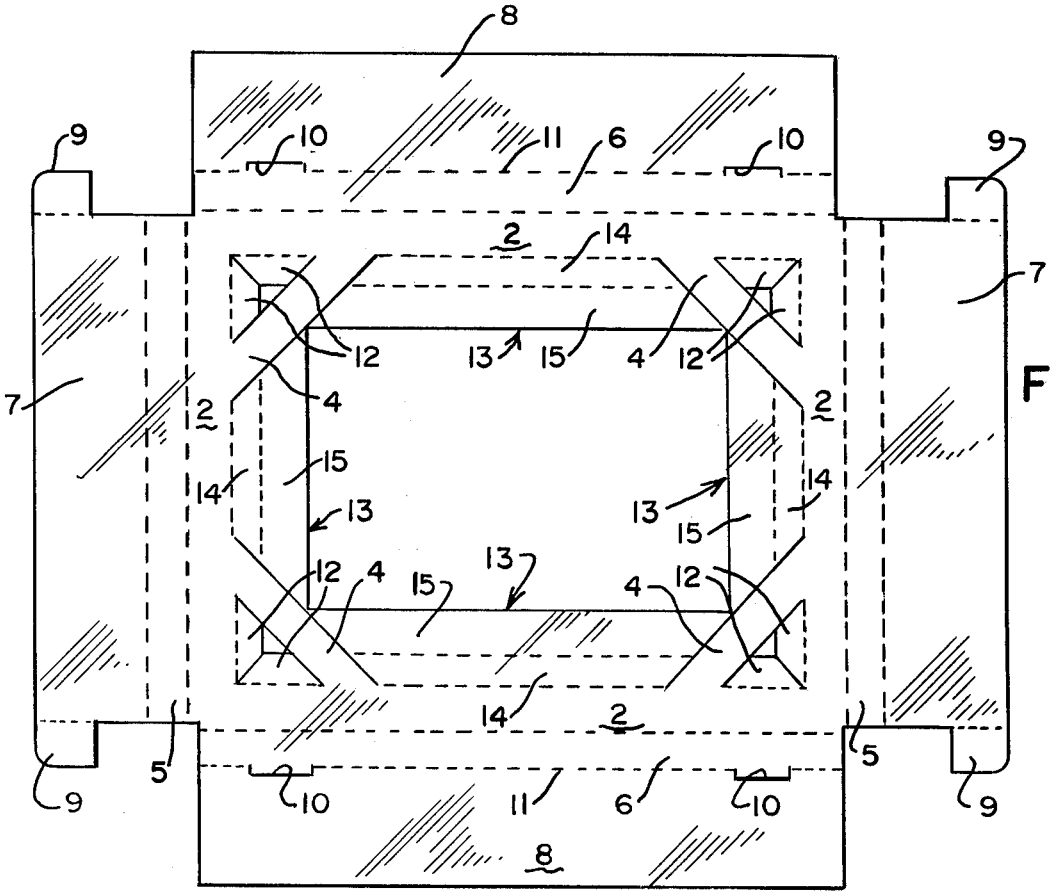
FIG. 5 provides a plan view of the picture display blank as used for folding into the configuration of the display as shown in FIG. 1.

As can also be seen from FIG. 5, there are a series of pairs of corner flanges 12 formed at the corners of the front perimeter frame 2, and within the confines of the integral straps 4, and these flanges are bent perpendicularly rearwardly with respect to the frame 2 in order to provide means for aiding in the positioning of the corners of any framed picture located within the display 1. Likewise, and to insure the central positioning of the framed picture within the display of this invention, a series of spacer means, as at 13, are provided only connecting around the inner edges of the front perimeter frame 2, and each of these spacer means is formed incorporating a first flange 14 which foldably connects with the inner edge of said frame 2, and having connected therewith a second flange 15. And, the flange 14 is first folded perpendicularly inwardly with respect to the perimeter frame 2, while the second flange 15 is folded once again at a ninety degree angle with respect to the first flange 14, and extends outwardly along the inner surface of the back perimeter frame for abutting against the interior of the side and end walls 5 and 6 to provide for convenient and stable positioning of the framed picture of this display. As can be seen, the second flanges 15 have a width approximating the width of the perimeter frame 2, so that the first flange 14 of each spacer means will be structurally positioned essentially perpendicular with respect to the front and back perimeter frames of the display, and therein aid in the convenient central positioning of any framed picture within the display.

In the folding of the blank, as shown in FIG. 5, into that usable form, as shown in FIG. 1, the front of the entire blank will be rested upon a surface. Then, the corner flanges 12 will be bent upwardly at approximately a perpendicular angle with respect to the said rested front perimeter frame 2. The combination of the first and second flanges 14 and 15 forming the spacer means 13 will likewise be bent upwardly at a perpendicular angle, with the flanges 15 then being bent outwardly into a horizontal position with the front frame. Then, the picture to be enclosed within the display will be rested upon the blank, within the interior of the now bent up corner flanges 12 and spacer means 13, and come to rest at its corners upon the straps 4 of the display. Obviously, the front of the framed picture, or its aesthetically appearing part, will be disposed for convenient viewing through this opening 3 provided within the front perimeter frame of the said display. Following this, the side and end walls 5 and 6 will be bent upwardly at approximately a ninety degree angle, so as to enclose the side edges of the emplaced picture, and the end flanges 8 will be bent another ninety degrees about their fold lines 11, and come to rest upon the back of the emplaced picture. Then, the side flanges 7 will likewise be bent over approximately ninety degrees with respect to the side walls 5, and come into overlying relationship upon the back side of the held picture, and against the flanges 8. At this point the tabs 9 can be bent over and inserted into the aligned slots 10, as previously explained, and therein secure the structured display firmly about the framed picture now enclosed therein. But, having done so, the picture will still be available for convenient viewing through the opening 3 provided through the front perimeter frame 2, with the corners of the framed picture being readily observable through the triangular openings provided between the straps 4 and the frame 2, with the only obstruction to a complete viewing of the embraced picture being the location of the straps 4 across its front. Where picture frames are of a rather artistic design, as most of them currently are, in order to enhance the aesthetics of the framed picture, it is desirable to provide clear viewing of their corners so that one may assure that the artistic designs of the frame is provided throughout its length, including its corners, and in addition, that said corners have not been damaged through rough treatment.

The foregoing provides a general illustration of the invention contemplated for the structural blank of this display. Various changes or modifications to its design may occur to those skilled in the art upon reviewing subject matter of this invention. Any such modifications, if within the spirit of this invention, are intended to be encompassed within the scope of any claims granted upon this invention. As previously commented, the description of the preferred embodiment, as set forth herein, is primarily for illustrative purposes.

Having thus described the invention, what is claimed and desired to be secured by Letters Patent is:

1. A paperboard picture display for use in protecting a framed picture in addition to affording a near complete viewing of any picture held therein, comprising, a front perimeter frame for the display, said frame having an opening therein and of dimensions slightly greater than the exterior dimensions of any picture being displayed, integral straps spanning the corner of the frame opening between segments of the perimeter frame and for holding any displayed picture therein, spacer means foldably connecting with the inner edges of the front perimeter frame and capable of bending inwardly of the display for contacting against the sides of any picture held therein and being useful for positioning any said displayed picture substantially centrally of the view opening, side and end walls foldably connecting with the outer edges of the perimeter frame, and a back perimeter frame foldably connecting with the said walls for securing a picture within the formed display, and including a pair of corner flanges foldably connecting with the adjacent segments of the perimeter frame at each corner thereof, said corner flanges being arranged within the confines of the spanning corner strap and extending toward the back perimeter frame to therein aid in the positioning of the held picture within the display.

2. The invention of claim 1 and wherein each spacer means includes a first flange foldably connecting with an inner edge of the front perimeter frame at its opening thereof and substantially extending the distance between the front and back perimeter frames of the display, a second flange foldably connecting with the first flange and having a width substantially equivalent to the width of the front perimeter frame, and said second flange extending towards and abutting against the interior of the proximate wall.

3. The invention of claim 1 and wherein said back perimeter frame includes a flange foldably connecting with each of the side and end walls, said flanges being arranged into parallel with the front perimeter frame, and fastening means holding said back frame securely into its folded arrangement.

4. The invention of claim 3 and wherein said fastening means include a tab extending from at least one of said back frame flanges, and disposed for retentive insertion into an aligned slot provided approximate the juncture of a proximate wall and the back perimeter frame.

5. A blank for a paperboard picture display as for use in protecting and affording viewing of a framed picture, comprising, a front perimeter frame, said frame having a view opening therein and of a dimension slightly greater than the exterior dimensions of any picture to be displayed, integral straps spanning at least a pair of corners between segments of the front perimeter frame, spacer means foldably connecting with the inner edges of the front perimeter frame and capable of bending inwardly of the frame display and useful for centrally positioning of a displayed picture within the opening for viewing, side and end walls foldably connecting with the outer edges of the front perimeter frame, and a back perimeter frame formed of flanges foldably connected with the said walls and upon folding securing the picture within the display, and including a pair of corner flanges foldably connecting with the adjacent segment of the perimeter frame at each corner thereof, said corner flanges being arranged within the confines of the spanning corner straps.

* * * * *